US005167206A

United States Patent [19]

Suga

[11] Patent Number: 5,167,206

[45] Date of Patent: Dec. 1, 1992

[54] CONTINUOUSLY VARIABLE VALVE TIMING CONTROL SYSTEM

[75] Inventor: Seiji Suga, Kanagawa, Japan

[73] Assignee: Atsugi Unisia Corporation, Japan

[21] Appl. No.: 707,086

[22] Filed: May 29, 1991

[30] Foreign Application Priority Data

May 31, 1990 [JP] Japan ..... 2-142493

[51] Int. Cl.[5] ..... F01L 1/34

[52] U.S. Cl. ..... 123/90.17; 123/90.31; 464/2

[58] Field of Search ..... 123/90.15, 90.17, 90.31; 464/2

[56] References Cited

U.S. PATENT DOCUMENTS

| | | | |
|---|---|---|---|
| 3,978,829 | 9/1976 | Takahashi et al. | 123/90.17 |
| 4,535,731 | 8/1985 | Banfi | 123/90.15 |
| 4,811,698 | 3/1989 | Akasaka et al. | 123/90.17 |
| 4,856,465 | 8/1989 | Denz et al. | 123/90.17 |
| 4,895,113 | 1/1990 | Speier et al. | 123/90.17 |

FOREIGN PATENT DOCUMENTS

| | | |
|---|---|---|
| 0147209 | 7/1985 | European Pat. Off. . |
| 0296885 | 12/1988 | European Pat. Off. . |
| 3247916 | 6/1984 | Fed. Rep. of Germany . |

*Primary Examiner*—E. Rollins Cross
*Assistant Examiner*—Weilun Lo
*Attorney, Agent, or Firm*—Ronald P. Kananen

[57] ABSTRACT

A continuously variable valve timing control system comprises a camshaft, a timing sprocket, and a helical sleeve disposed between the camshaft and the timing sprocket to provide a drive connection therebetween. The helical sleeve is axially movable between two limit axial positions to vary a phase between the camshaft and timing sprocket. An instantaneous axial position of the helical sleeve is detected. A split, coned sleeve holds a motion sensing rod for restraining the helical sleeve moving in both axial directions when the instantaneous axial position detected reaches a new axial position.

11 Claims, 3 Drawing Sheets

CONTINUOUSLY VARIABLE VALVE TIMING CONTROL SYSTEM

BACKGROUND OF THE INVENTION

The present invention relates to a variable valve timing control system for an engine of an automobile.

U.S. Pat. No. 4,535,731 discloses a system for automatically varying the timing of a camshaft relative to a drive shaft of an internal combustion engine. This system comprises an axially slidable splined sleeve which connects the camshaft to its drive pulley, and is operated by the engine hydraulic fluid in such a manner as to change the angular position of the camshaft by way of a valve controlled by an electromagnetic actuator. The sleeve is axially movable between two limit positions, one being set by a return spring, and the other being set by application of the hydraulic fluid. Thus, the angular position of the camshaft is adjustable to only two positions.

An object of the present invention is to provide a continuously variable valve timing system wherein the angular position of the camshaft is continuously varied.

A specific object of the present invention is to provide a continuously variable valve timing system wherein, without relying on a feedback control to change the level of the hydraulic fluid, the angular position of the camshaft is continuously varied.

SUMMARY OF THE INVENTION

According to the present invention, there is provided a continuously variable valve timing control system for an engine, comprising:

a camshaft;

a driver member;

a helical sleeve disposed between said camshaft and said driver member to provide a drive connection therebetween, said helical sleeve being axially movable between two limit positions to vary a phase between said camshaft and driver member;

means for actuating said helical sleeve to move between said two limit positions; wherein an instantaneous position of said helical sleeve is detected, and there is provided means for restraining said helical sleeve moving in the two opposite directions when said instantaneous position detected reaches a new position, whereby said new position may vary continuously from one of said two limit positions to the other limit position.

DETAILED DESCRIPTION OF THE INVENTION

Figure 1:
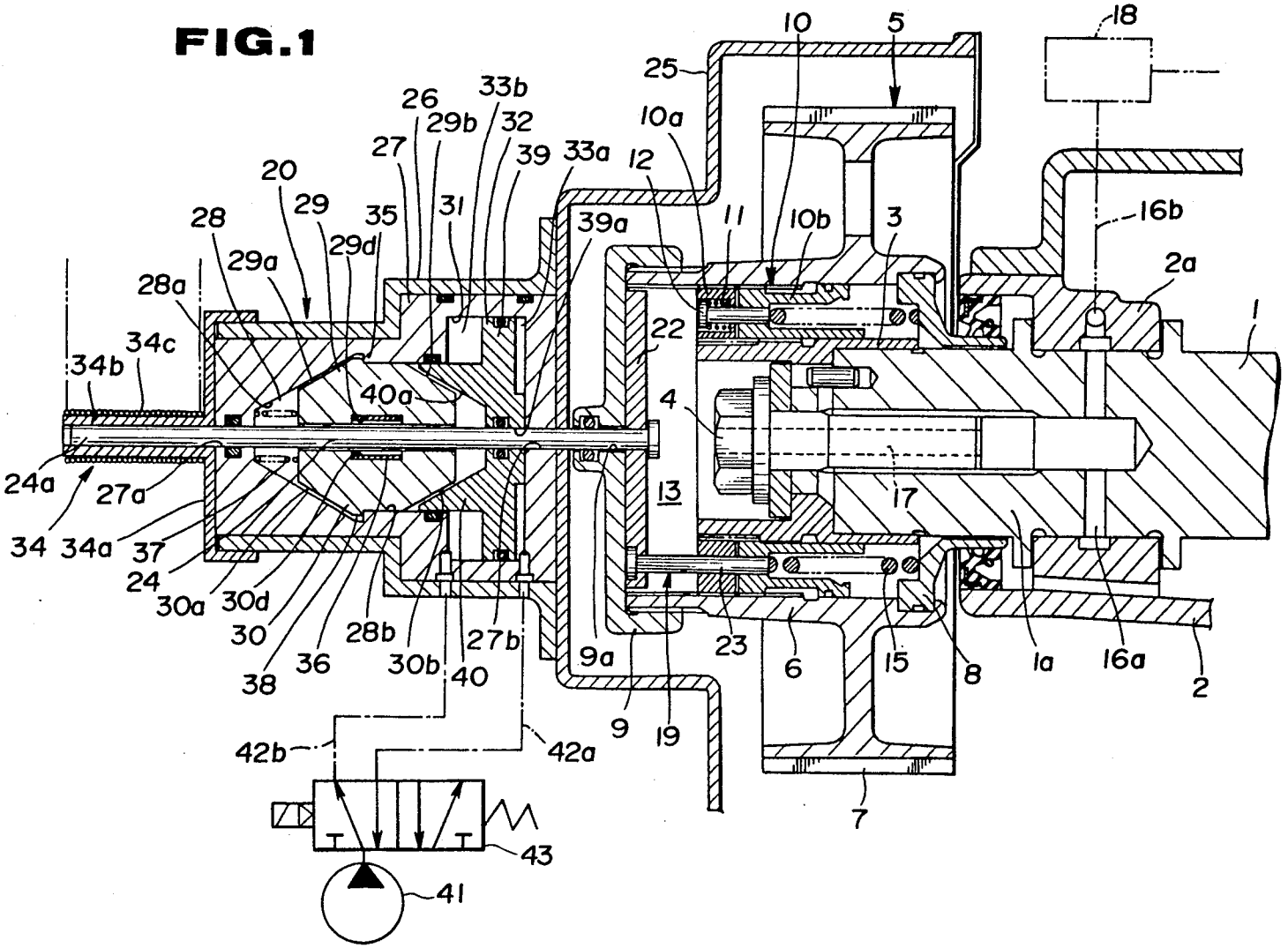
FIG. 1 is a fragmentary section of an engine of an automobile, illustrating an embodiment of a continuously variable valve timing control system according to the present invention.

Referring to FIG. 1, a portion of a DOHC engine is shown which includes a camshaft 1 rotatably supported via a bearing 2*a* on a cylinder head 2. The camshaft 1 includes an end portion 1*a* projecting outwardly into a chain or belt cover 25 from a longitudinal end of the cylinder head 2. The end portion 1*a* of the camshaft 1 has a cap 3 fixedly secured thereto for rotation therewith by means of a hollowed bolt 4. The hollowed bolt 4 is screwed axially inwardly from the axial end of the end portion 1*a* and defines an axial fluid passage 17. A flanged ring 8 is coupled with the end portion 1*a* in abutting engagement with the adjacent axial end of the cap 3 and splined to the camshaft 1. Disposed within the cover 25 is a driver member, i.e., a timing pulley 5. The timing pulley 5 includes a toothed portion 7 and a sleeve 6 which is drivingly coupled with the cap 3 via an axially split helical sleeve 10. The sleeve 6 has a righthand end, as viewed in FIG. 1, closed by the flanged ring 8 and a lefthand end, as viewed in FIG. 1, closed by a circular end plate 9. As readily seen from FIG. 1, the sleeve 6 cooperates with the circular end plate 9, the end portion 1*a* of the camshaft 1, and the helical sleeve 10 to define a pressure chamber 13. Although not illustrated, under the control of a control unit, an electromagnetic valve 18 determines a hydraulic fluid pressure in a fluid line 16*b*. Supply of hydraulic fluid to and discharge from the pressure chamber 13 is effected through the fluid line 16*b*, a radial passage 16*a* and the axial passage 17.

The helical sleeve 10 is axially divided into two annular pieces 10*a* and 10*b* which are interconnected by a plurality of pins, including a short pin 12 and an elongated pin 23. The short pin 12 is biased by a spring 11. A return spring 15 for the helical sleeve 10 is operatively disposed between the flanged ring 8 and the piece 10*b*. The helical sleeve 10 is formed with helical teeth on at least one of its inner and outer cylindrical surfaces and in mesh with an inner spline of the sleeve 6 and an outer spline of the cap 3 for providing a drive connection between the timing pulley 5 and the camshaft 1.

Denoted by the reference numeral 19 is a motion transmitting mechanism which includes the elongated pin 23, a floating disc 22 disposed in the chamber 13, and a motion sensing rod 24. The motion transmitting mechanism 19 is so constructed and arranged as to transmit at least an axial motion of the helical sleeve 10 to the motion sensing rod 24. The elongated pin 23 is fixedly connected to the disc 22 for unitary motion. The axial distance between the disc 22 and the helical sleeve 10 is so chosen that the disc 22 abuts the inner wall of the circular end plate 9 under the bias of the return spring 15, as illustrated in FIG. 1. Thus, FIG. 1 illustrates a spring set limit position of the helical sleeve 10, i.e., one of two limit positions of the helical sleeve 10. The motion sensing rod 24 is fixedly connected to the disc 22 and extends through a central opening 9*a* of the circular end plate 9 and then through the cover 25 outwardly. The central opening 9*a* is sealed in a liquid tight manner.

Denoted by the reference numeral 20 is a device to releasably restrain the helical sleeve 10 moving in both axial directions after the helical sleeve 10 has left its limit positions. This restraining device 20 includes a tubular housing 26 having a flanged end fixedly secured to the cover 25 and coaxially extends in the axial direction of the motion sensing rod 24. The tubular housing 26 has an open end closed by an end plate 34*a* made of a synthetic resin.

Figure 3:
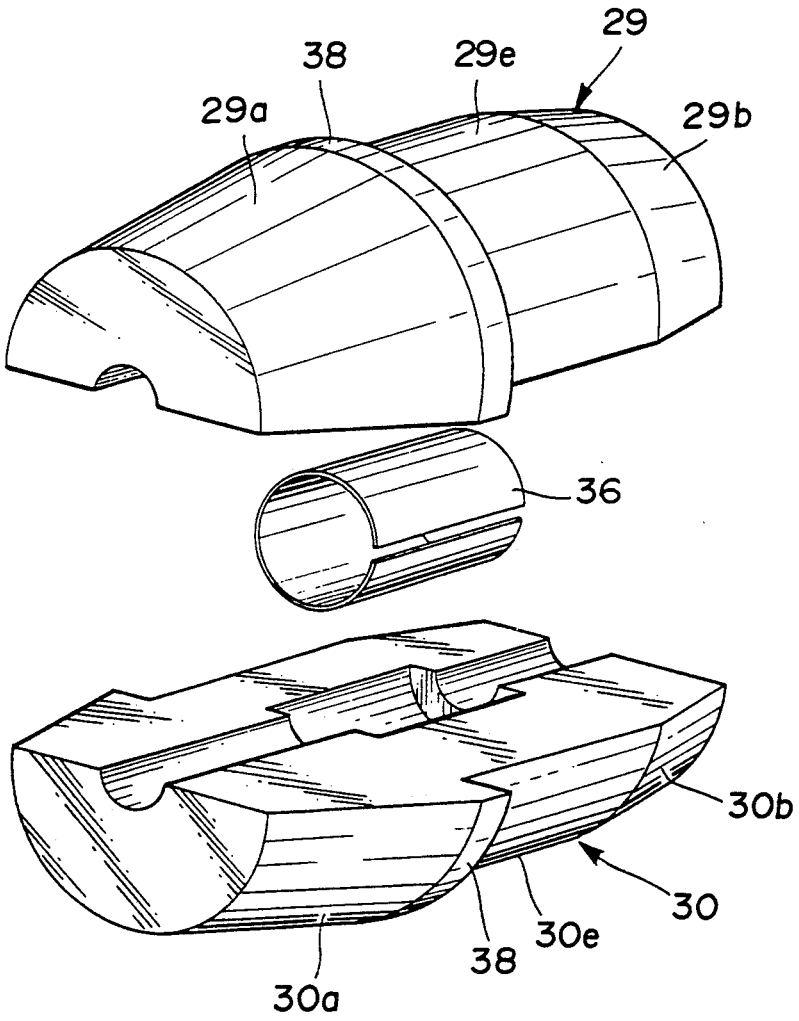
FIG. 3 is an enlarged exploded view of a split, coned sleeve.

Disposed within the tubular housing 26 is a generally annular body 27. The body 27 has a pair of axially spaced bores 27*a* and 27*b* through which the motion sensing rod 24 extends. Defined between the pair of bores 27*a* and 27*b* are a piston receiving axial cylindrical bore 31, a reduced diameter cylindrical bore 28*b* and a conical bore 28. The conical bore 28*a* has its tapered end connected to the bore 27*a* and its opposite end connected to the reduced diameter bore 28*b* through an annular shoulder 35. The restraining device 20 includes a split coned sleeve 29 and 30 as best seen in FIG. 3. The split coned sleeve 29 and 30 is disposed in the conical bore 28*a* and the reduced diameter bore 28*b* and is biased by a spring 37 to a spring set position as illustrated in FIG. 1. In this spring set position illustrated in FIG. 1, the sleeve portions 29 and 30 are radially spaced apart by a radial expansion slotted ring 36 so that their cylindrical wall portions 29*e* and 30*e* are pressed against the cylindrical wall of the reduced diameter bore 28*b*, while the spring 37 biases the sleeve portions 29 and 30 until their circular shoulders 38 are pressed against the shoulder 35 of the bore. In this position, the conical tapered walls 29*a* and 30*a* of the sleeve portions 29 and 30 are spaced from the conical bore defining wall 28*a*. Disposed within the cylindrical bore 31 is an annular piston 39 formed with a central bore 39*a* through which the motion sensing rod 24 extends. The piston 39 divides the interior of the cylindrical bore 31 into an apply chamber 33*a* and a release chamber 33*b*. The piston 39 has an integral reduced diameter working piston portion 40 formed with a conical bore 40*a* opposed to conical tapered walls 29*b* and 30*b* of the sleeve portions 29 and 30. This working portion 40 is slidably received in the reduced diameter bore portion 28*b*. In FIG. 1, the piston 39 is in its rest position where the conical bore 40*a* defining wall is spaced from the conical tapered walls 29*b* and 30*b* of the sleeve portions 29 and 30.

Figure 2:
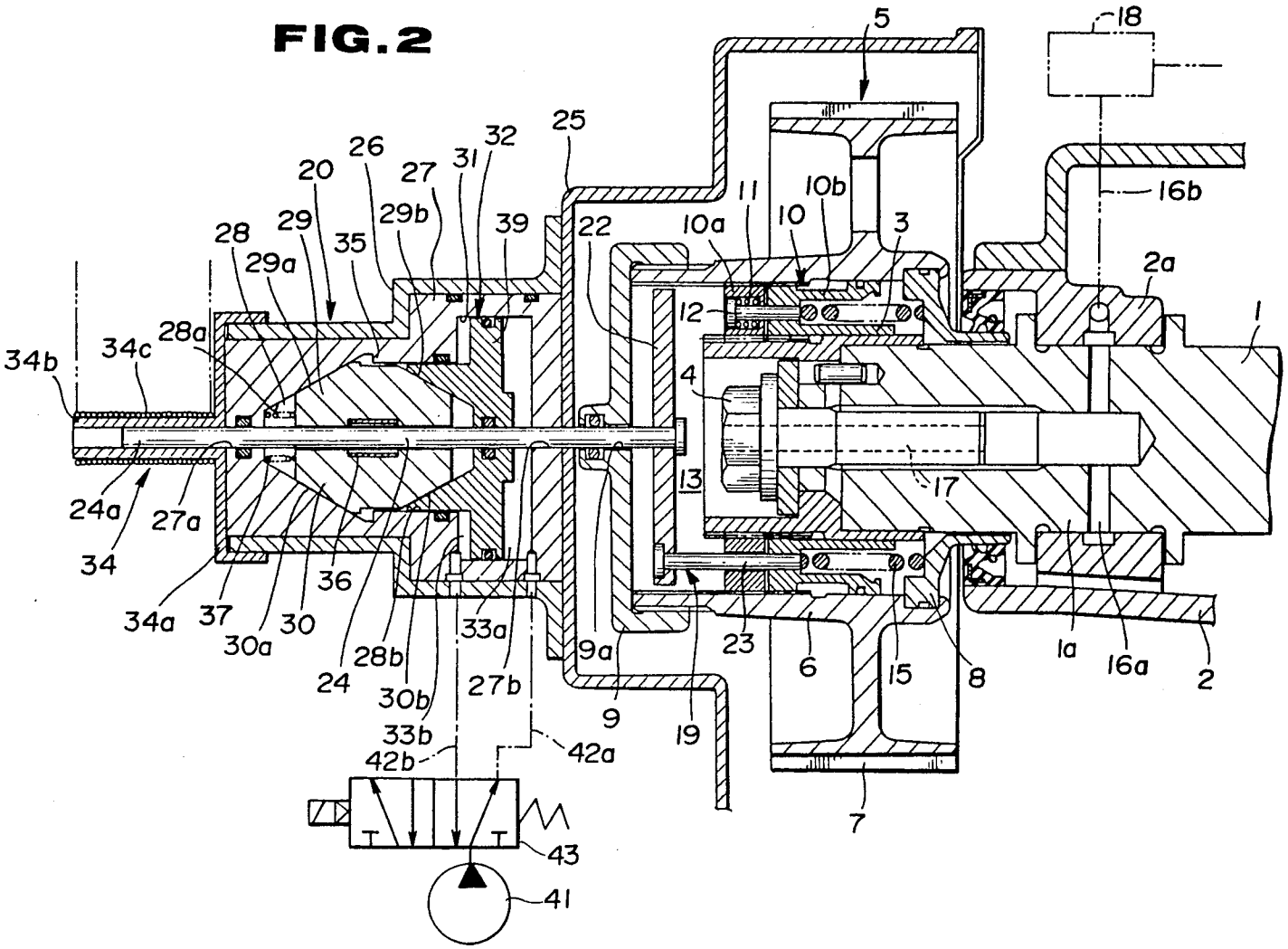
FIG. 2 is a similar view to FIG. 1 used for explaining an operation.

The supply of hydraulic fluid to each of the apply and release chambers 33*a* and 33*b* is controlled by an electromagnetic valve 43. When it takes the position as illustrated in FIG. 1, the hydraulic fluid discharged from a pump 41 is supplied via a fluid line 42*b* to the release chamber 33*b*, while the hydraulic fluid is discharged from the apply chamber 33*a* via a fluid line 42*a*. When the valve 43 shifts to a position as illustrated in FIG. 2, the hydraulic fluid is discharged from the release chamber 33*b* and the hydraulic fluid is supplied to the apply chamber 33*a*, urging the piston 39 to urge the split coned sleeve 29 and 30 to hold the motion sensing rod 24 and into firm engagement with the body 35. Under this condition, the axial motion of the motion sensing rod 24 and thus the helical sleeve 10 is restrained, although its rotational motion is allowed since the body 27 rotates with the motion sensing rod 24.

The motion sensing rod 24 has an end portion 24*a* extending into a sleeve 34*b* integral with the end plate 34*a*. The sleeve 34*b* is surrounded by a coil 34*c* which forms a part of a electromagnetic pick-up of a rod stroke sensor 34.

The operation is as follows:

During stroke of the helical sleeve 10 between its two limit positions, the valve 43 takes the position as illustrated in FIG. 1 to allow free axial motion of the motion sensing rod 24. The helical sleeve 10 moves from the position illustrated in FIG. 1 toward the right as viewed in FIG. 1 if the pressurized hydraulic fluid is supplied to the chamber 13 by placing the electromagnetic valve 18 at one of two positions thereof. If reverse movement of the helical sleeve 10 is desired, the electromagnetic valve 18 is shifted to the other position to discharge hydraulic fluid from the chamber 13. The instantaneous axial position of the helical sleeve 10 is detected by the stroke sensor 34. Thus, if the instantanous axial position of the helical sleeve 10 reaches a desired position, the valve 43 is switched to the position shown in FIG. 2 to urge the split coned sleeve 29 and 30 to hold the motion sensing rod 42. In this manner, without any delay, the helical sleeve is locked to the desired axial position.

What is claimed is:

1. A continuously variable valve timing control system for an engine, comprising:

a camshaft;

a driver member;

a helical sleeve disposed between said camshaft and said driver member to provide a drive connection therebetween, said helical sleeve being movable between two limit positions to vary a phase between said camshaft and said driver member;

means for actuating said helical sleeve to move between said two limit positions, and a restraining mechanism having a first position in which said restraining mechanism locks said helical sleeve and a second position in which said restraining mechanism allows free motion of said helical sleeve, said restraining mechanism including, means for biasing said mechanism toward said second position; and means for urging said mechanism to said first position against said biasing means.

2. A continuously variable valve timing control system as claimed in claim 1, further comprising means for detecting an instantaneous position of said helical sleeve.

3. A continuously variable valve timing control system as claimed in claim 2, wherein said detecting means includes a motion transmitting mechanism, including a motion sensing rod, which is so constructed and arranged as to transmit at least an axial motion of said helical sleeve to said motion sensing rod.

4. A variable valve timing control system as claimed in claim 3, wherein said detecting means includes an electromagnetic pick-up for transducing an axial position of said motion sensing rod.

5. A variable valve timing control system as claimed in claim 4, wherein said electromagnetic pick-up includes a coil around a portion of said motion sensing rod.

6. A variable valve timing control system as claimed in claim 4, where said restraining mechanism includes a split coned sleeve arranged to hold said motion sensing rod.

7. A variable valve timing control system as claimed in claim 6, wherein said restraining mechanism includes an annular body and wherein said urging means includes an annular hydraulic piston around said motion sensing rod, said annular body and said annular hydraulic piston being constructed and arranged to interpose therebetween said split coned sleeve.

8. A variable valve timing control system as claimed in claim 7, wherein said biasing means includes a radial expansion slotted ring around said motion sensing rod and disposed between said split coned sleeve.

9. A continuously variable valve timing control system for an engine, comprising:

a camshaft;

a driver member;

a helical sleeve disposed between said camshaft and said driver member to provide a drive connection therebetween, said helical sleeve being movable between two limit positions to vary a phase between said camshaft and said driver member;

means for actuating said helical sleeve to move between said two limit positions, wherein an instantaneous position of said helical sleeve is detected;

means for restraining said helical sleeve moving in the two opposite directions when said instantaneous position detected reaches a new position, whereby said new position may vary continuously from one of said two limit positions to the other limit position; and means for detecting said instantaneous position of said helical sleeve, wherein said detecting means includes a motion transmitting mechanism, including a motion sensing rod, which is so constructed and arranged as to transmit at least an axial motion of said helical sleeve to said motion sensing rod, and an electromagnetic pick-up for transducing an axial position of said motion sensing rod, wherein said restraining means includes a split coned sleeve arranged to hold said motion sensing rod.

10. A variable valve timing control system as claimed in claim 9, wherein said electromagnetic pick-up includes a coil around a portion of said motion sensing rod.

11. A variable valve timing control system as claimed in claim 9, wherein said restraining means includes an annular body and an annular hydraulic piston around said motion sensing rod to interpose therebetween said split coned sleeve.

* * * * *